US005764459A

United States Patent [19]

Yang

[11] Patent Number: 5,764,459

[45] Date of Patent: *Jun. 9, 1998

[54] DC CIRCUIT BREAKING SPARK SUPPRESSOR DEVICE

[76] Inventor: Tai-Her Yang, No. 32 Lane 29, Taipin St., Si-Hu Town, Dzan-Hwa, Taiwan

[ * ] Notice: The term of this patent shall not extend beyond the expiration date of Pat. No. 5,666,257.

[21] Appl. No.: 640,058

[22] Filed: Apr. 30, 1996

Related U.S. Application Data

[63] Continuation-in-part of Ser. No. 324,668, Oct. 18, 1994, Pat. No. 5,666,257.

[51] Int. Cl.[6] ..... H01H 9/30

[52] U.S. Cl. ..... 361/2; 361/139; 307/113

[58] Field of Search ..... 361/2, 3, 10, 11, 361/139, 152, 166, 170, 191, 206; 307/112, 116, 113, 134, 137, 139

[56] References Cited

U.S. PATENT DOCUMENTS

| | | | |
|---|---|---|---|
| 3,252,014 | 5/1966 | Seulen | 361/11 |
| 3,566,152 | 2/1971 | Casey et al. | 307/133 |
| 3,739,192 | 6/1973 | Oswald | 307/136 |
| 4,296,449 | 10/1981 | Eichelberger | 361/3 |
| 4,504,773 | 3/1985 | Suzuki et al. | 361/3 |

*Primary Examiner*—Fritz Fleming
*Attorney, Agent, or Firm*—Bacon & Thomas

[57] ABSTRACT

A DC circuit breaking spark suppressor device includes first and second main switch components having sequentially linked contacts for connecting a DC power supply to a main load, and a capacitor connected in parallel with the first switch component to store electricity when the first main switch component is opened, the second switch component being opened after opening of the first main switch component to disconnect the load from the power supply, after which the capacitor discharges through a discharge resistor. The discharge circuit includes a switch apart from said main switch components to isolate the discharge circuit prior to discharge, and an additional damping inductor. Alternatively, isolation of the discharge circuit may be achieved adding a contact to the second main switch component such that when the load is disconnected from the power supply, the discharge circuit is closed to cause the capacitor to discharge through the discharge resistor.

2 Claims, 2 Drawing Sheets

DC CIRCUIT BREAKING SPARK SUPPRESSOR DEVICE

This application is a continuation-in-part of application Ser. No. 08/324,668, filed Oct. 18, 1994, now U.S. Pat. No. 5,666,257.

SUMMARY OF THE INVENTION

The fact is well known that when the switch between the DC power and the load side is cut off, the residual spark from the air ionization between the contact points is very harmful to the life of the switch contacts. In the present invention, a main switch having sequentially linked contacts is matched with a capacitor which is parallel combined with the main switch to distribute the transient currents, thereby reducing the residual sparking phenomenon when the main switch is cut off.

DETAILED DESCRIPTION OF THE PREFERRED EMBODIMENTS

Figure 1:
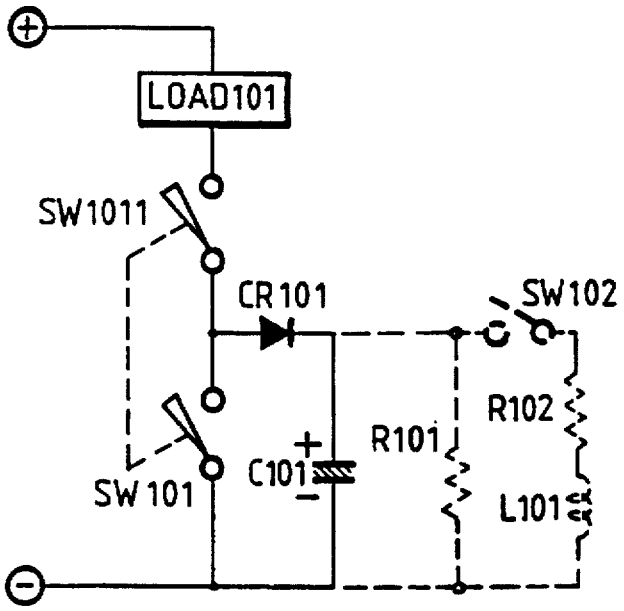
FIG. 1 is a schematic circuit diagram illustrating principles of a first preferred embodiment of the invention.

FIG. 1 is a schematic circuit diagram of a DC circuit breaking spark suppressor circuit device which includes a DC power source, the switching components, a capacitor, a separator diode and auxiliary discharge circuit components, as follows:

- The DC power source can include either a pure DC or pulse DC source;
- The load LOAD101 can include various resistive or inductive loads, or a mixture of both types of loads or motors;
- The electromechanical components SW101 and SW1011 have sequentially linked contacts for series combination with the load, and then parallel combination with the DC power source, such that when the electromechanical switch is in an ON state, switch SW1011 is closed before switch SW101, and when the electromechanical switch is in an OFF state, switch SW1011 is cut off after switch SW101, the sequential linking methods including mechanically operated or electronic circuit controlled sequential linkages;
- The isolator diode CR101 is series combined with the capacitor C101 based on DC power source polarities, and is parallel combined with the two ends of the electromechanical component SW101;
- A drain current resistor R101 is directly parallel combined with capacitor C101, or the drain current resistor R102 is first series combined with the control switch SW103 and then parallel combined with the two ends of capacitor C101 for discharging the capacitor at a proper time, the above-mentioned drain current resistor R102 including the inductive load L101 which is used for mutual series combination and simultaneously as a drain current load.

In this embodiment, the above-described capacitor absorbs the current at the instant of switch cut-off to improve the residual spark, and then the stored electricity in the capacitor is discharged to prepare for spark suppression during the second switch cut-off.

Figure 2:
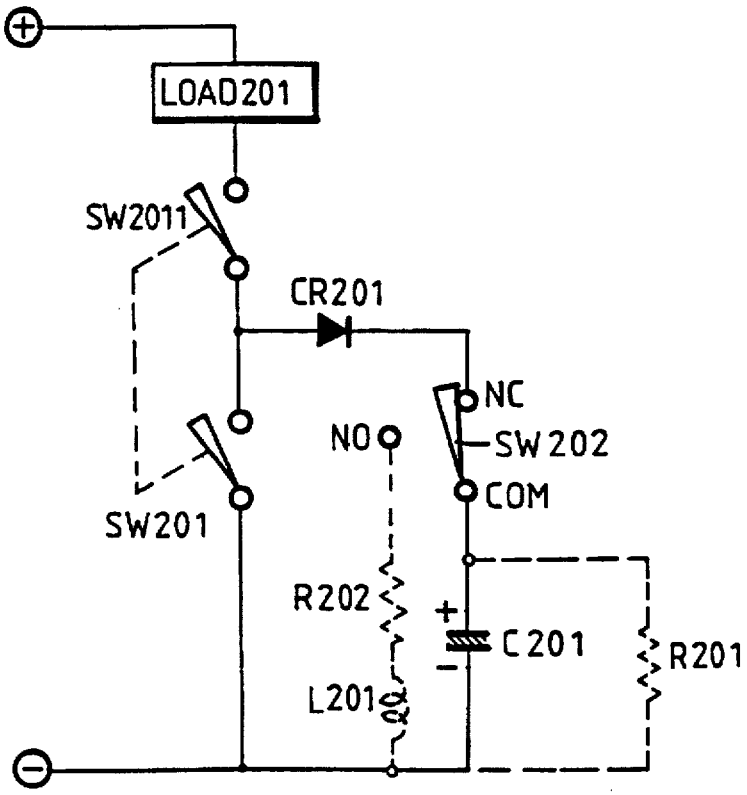
FIG. 2 is a schematic diagram of a second preferred embodiment of the invention applied to two separated sequentially cut-off switches.

FIG. 2 is a schematic diagram of an embodiment in which the DC circuit breaking spark suppressor circuit device is further combined with two separate sequentially cut-off switches, as follows:

- The DC power source including the pure DC or pulse DC;
- The load LOAD201 can include various resistive or inductive loads, or a mixture of both types of loads or motors;
- The electromechanical components SW201 and SW2011 have sequentially linked contacts for series combination with the load, and then parallel combination with the DC power source, such that when the electromechanical switch is in an ON state, switch SW2011 is closed before switch SW201, and when the electromechanical switch is in an OFF state, switch SW2011 is cut off after switch SW201, the sequential linking methods including mechanically operated or electronic circuit controlled sequential linkages;
- The isolator diode CR201 is series combined with capacitor C201 based on DC power source polarities, and is parallel combined with the two ends of the electromechanical component SW201;
- A drain current resistor R201 is directly parallel combined with capacitor C201, or the drain current resistor R202 is first series combined with the control switch SW202 and then parallel combined with the two ends of capacitor C201 for discharging the capacitor at a proper time, the above-mentioned drain current resistor R202 also being series combined with the inductive load L201 to function as a drain current resistor;
- An isolator diode CR201 is first series combined with the capacitor C201 through the normally closed contact NC and common contact COM of the drain current switch SW202 and is then parallel combined with the two ends of the electromechanical component SW201, and the drain current resistor R202 (which is preferably series combined with an inductive load L201) is series combined with the ground terminal of the capacitor and the normal open contact terminal of the drain current switch NO, to thereby discharge capacitor residual electricity when the normally open contact NO and the common contact COM are connected.

In operation, when electromechanical switches SW201 and SW2011 are opened, the drain current switch SW202 is in a position connecting the common contact COM and the normally closed contact NC. It is then switched to a position on the common contact and the normally open contact NO to provide for suppressing the spark phenomenon generated during the cut-off instant of the switches SW201 and SW2011.

Figure 3:
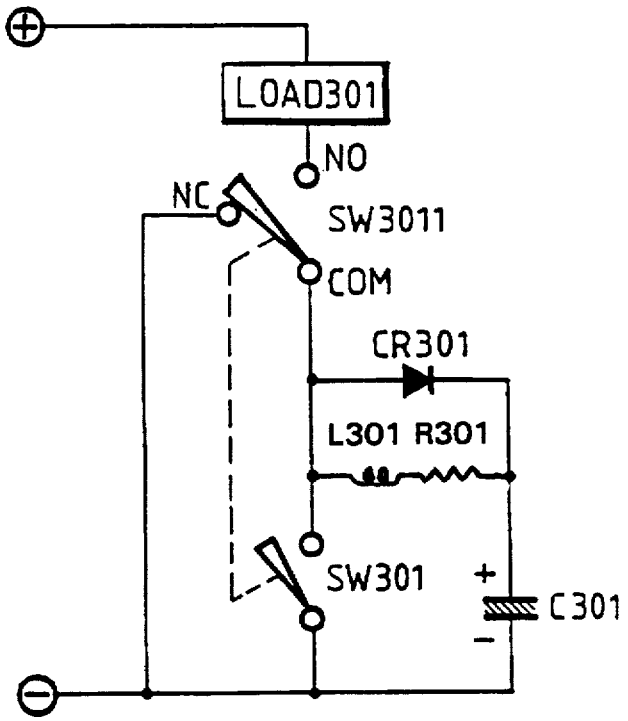
FIG. 3 is a schematic diagram of a third preferred embodiment of the invention.

FIG. 3 shows a third preferred embodiment of a DC circuit breaking spark suppressor circuit device which includes a DC power source, sequentially linked switching components, a capacitor and the auxiliary discharging components, as follows:

- The DC power source can either be pure DC or pulse DC;
- The load LOAD301 can include various resistive or inductive loads, or a mixture of both types of loads or motors;
- The electromechanical components SW301 and SW3011 have sequentially linked contacts for series combination with the load, and then parallel combined with the DC power source, such that the switch SW301 has a normally open contact, and its two terminals are parallel combined with a diode CR301 and capacitor C301 in series combination following the order of polarities, the two ends of the diode CR301 being parallel combined with the drain current resistor R301, and switch SW3011 having common contact COM, a normally closed contact NC and a normally open contact NO, wherein the common contact COM of SW3011 is series combined with switch SW301 to connect to the negative terminal of the power source, the normally open contact NO of the SW3011 is series combined with the load LOAD301 to connect to the positive terminal of the power source, and the normally closed contact NC is directly connected with the negative terminal of the power source so that when the electromechanical switch is in an ON state, the switch SW3011 is closed ahead of the SW301, and when the electromechanical switch is in an OFF state, switch SW3011 is cut off after switch SW301, the sequential linking methods including mechanically operated or electronic circuit controlled sequential linkages;

The drain current resistor R301 can include resistors or any other energy consuming discharging components, and is preferably series combined with an inductive load L301.

Figure 4:
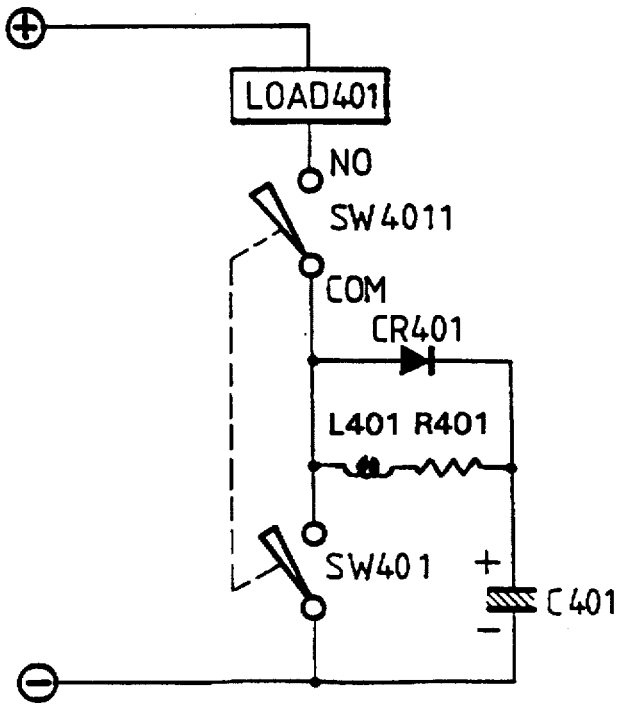
FIG. 4 is a schematic diagram of a fourth preferred embodiment of the invention.

FIG. 4 is a fourth preferred embodiment of the DC circuit breaking spark suppressor circuit device of the invention, which again includes a DC power source, sequentially linked switching components, a capacitor and the auxiliary discharging components, as follows:

The DC power source can include either a pure DC or pulse DC source;

The load LOAD401 can include various resistive or inductive loads, or a mixture of both types of loads or motors;

The electromechanical components SW401 and SW4011 have sequentially linked contact for series combination with the load and then parallel combination with the DC power source, the SW401 having normally open contact, the two terminals of switch SW401 being parallel combined with diode CR401 and capacitor C401, which are in series combination based on polarity, the two ends of the diode CR401, and the switch SW4011 having a common contact COM and a normally open contact NO, wherein the common contact COM of SW4011 is series combined with SW401 to connect it to the negative terminal of the power source, the normally open contact NO of the switch SW4011 is series combined with the load LOAD401 to connect it to the positive terminal of the power source, and such that when the electromechanical switch is in an ON state, the switch SW4011 is closed ahead of the switch SW401, and when the electromechanical switch is in an OFF state, the switch SW401 1 is cut off before the switch SW401, the sequential linking methods including either mechanically operated or electronic circuit controlled sequential linkages;

The drain current resistor R401 can be made up either of resistors or other energy consuming discharging components and is preferably series combined with an inductive load L401.

In practice, the above described DC circuit breaking spark suppressor circuit device can be multiple series or parallel combined, with the aforesaid drain current resistor and the series combined inductor being comprised of resistive inductors.

In the examples of FIGS. 1–4, the contact can be applied with a single contact or multiple contacts including series combinations or parallel combinations thereof, and can be applied in the electricity circuit breakers, electromagnetic switches, manually operated switches or overload circuit breakers, etc.

In summary, the invention provides a capacitor that is series combined with a main switch to distribute transient current and reduce the residual spark phenomenon generated when the main switch cuts off a DC current.

I claim:

1. In a DC circuit breaking spark suppressor device, including:

first and second main switch components having sequentially linked contacts for connecting a DC power supply to a main load;

a capacitor connected in parallel with the first switch component to store electricity when said first main switch component is opened, said second switch component being opened after opening of the first main switch component to disconnect the load from the power supply;

a circuit which includes a discharge resistor for discharging said capacitor after said second switch has opened; and an isolator diode connected in parallel with said discharge resistor, the improvement wherein:

said discharge resistor is series combined with an inductive load and said second main switch component includes a normally open contact connected to said main load, a normally closed contact connected directly to said capacitor, and a common contact, such that when said normally closed contact is connected to said common contact said capacitor is disconnected from said main load and discharges through said discharge resistor and said inductive load; and when said normally open contact is connected to said common contact and said first main switch component is opened, said capacitor charges through said isolator diode.

2. In a DC circuit breaking spark suppressor device, including:

first and second main switch components having sequentially linked contacts for connecting a DC power supply to a main load;

a capacitor connected in parallel with the first switch component to store electricity when said first main switch component is opened, said second switch component being opened after opening of the first main switch component to disconnect the load from the power supply;

a circuit which includes a discharge resistor for discharging said capacitor after said second switch component has opened; and an isolator diode connected in parallel with said discharge resistor, the improvement wherein:

said discharge resistor is series combined with an inductive load and said second main switch component includes a normally open contact connected to said main load and a common contact, such that when said normally open contact is connected to said common contact and said first main switch component is open, said capacitor charges through said isolator diode, after which the first main switch component is closed, and when said normally open contact is disconnected from said common contact and the first main switch component is still closed, said capacitor discharges through said resistor and inductive load.

* * * * *